US006043788A

United States Patent [19]

Seavey

[11] Patent Number: 6,043,788

[45] Date of Patent: Mar. 28, 2000

[54] LOW EARTH ORBIT EARTH STATION ANTENNA

[76] Inventor: John M. Seavey, 339 Beachwood St., Cohasset, Mass. 02025

[21] Appl. No.: 09/126,912

[22] Filed: Jul. 31, 1998

[51] Int. Cl.[7] ..... H01Q 13/00

[52] U.S. Cl. ..... 343/781 CA; 343/781 P; 343/765; 343/840

[58] Field of Search ..... 343/781 CA, 781 R, 343/781 P, 840, 915, 786, 765, 757, 758, DIG. 2; 455/12.1; H01Q 13/00

[56] References Cited

U.S. PATENT DOCUMENTS

| | | | |
|---|---|---|---|
| 4,203,105 | 5/1980 | Dragone et al. | 343/781 P |
| 4,710,734 | 12/1987 | Sterns | 343/756 |
| 4,866,457 | 9/1989 | Hogg | 343/781 CA |
| 5,075,682 | 12/1991 | Dehnert | 343/765 |
| 5,734,962 | 3/1998 | Hladik et al. | 455/12.1 |
| 5,796,370 | 8/1998 | Courtonne et al. | 343/781 |

*Primary Examiner*—Don Wong
*Assistant Examiner*—Tho Phan
*Attorney, Agent, or Firm*—Kenneth W. Float

[57] ABSTRACT

An improved very small antenna terminal (VSAT) dual-beam antenna system for use with user subscriber terminals that communicate with low-earth orbiting and other satellites. In one embodiment, the dual-beam antenna system has two offset Gregorian dual-reflector antennas that each has an ellipsoidal subreflector and a rotatable paraboloidal reflector having a focus in common with a focus of the ellipsoidal subreflector. The rotatable paraboloidal reflector couples energy to and from the ellipsoidal subreflector. An RF feed system couples RF energy to and from the ellipsoidal subreflector. Rotating apparatus rotates the paraboloidal reflector and ellipsoidal subreflector together around an azimuth axis of the antenna. The rotating apparatus independently and simultaneously rotates the paraboloidal reflector about an axis between the paraboloidal reflector and ellipsoidal subreflector which points the antenna at an orbiting satellite. A controller is coupled to the rotating apparatus that controls rotation of the paraboloidal reflector and the antenna to point the antenna toward the orbiting satellite. The two antennas are preferably mounted side-by side and the one antenna is pointed at a first satellite while the second antenna tracks a rising satellite. A VSAT radio is automatically handed-off to the rising LEO satellite by switching it from the one antenna to the second antenna. Another embodiment may be used to track a inclined-orbit satellite having a figure-eight orbit, wherein the actuators move the antenna more slowly to track the satellite. Another embodiment employs a single antenna that is fixed relative to an orbiting satellite.

18 Claims, 14 Drawing Sheets

LOW EARTH ORBIT EARTH STATION ANTENNA

BACKGROUND

The present invention relates generally to antennas, and more particularly, to a low-cost, very small antenna terminal (VSAT) antenna system for user subscriber terminals which may be used to access low-earth orbiting (LEO) and other satellite communications systems.

Currently planned Ka-band low-earth orbiting (LEO) satellite communications systems include Teledesic (Teledesic LLC) and Spaceways (Hughes) satellite communications systems. Typically, these satellite communications systems operate in the 20–30 GHz bandwidth region. The satellites carrying the communications systems orbit the Earth in low earth orbit at approximately 1400 kilometers. The satellites of a typical LEO constellation orbit the Earth in a matter of hours.

The satellite communications systems communicate with user subscriber terminals that each employ a very small antenna terminal (VSAT) antenna system. The user subscriber terminals are fixed on the Earth and sequentially acquire each of the orbiting satellites as they pass through the field of view of the antenna system. The antenna system thus forms a critical part of the LEO subscriber terminal that is used to communicate with the LEO satellite communications system. Because the LEO satellite communications systems are used to interface to a large number of subscribers, a low-cost antenna system is important to ensure purchase of systems by subscribers. A production cost target of $400–$500 is desired for a complete antenna system.

From a technical standpoint, the antenna system should provide high gain with a low noise temperature. The antenna system should operate with selectable circular polarization and low axial ratio. High isolation should be provided between 20 GHz receive signals and 30 GHz uplink signals.

Two independent beams are thus required, one that tracks an active satellite while transmitting and receiving, and another that anticipates the angular position of and has its receiver functioning for the rising of the next satellite that is to be communicated with. Upon hand-off to the rising satellite, the transmitter is switched to the new satellite and the cycle is repeated. Tracking may be done using stored or downlinked ephemeris data. The VSAT subscriber terminal may be accurately sited by an installing technician, such as by using the global positioning system and an electronic compass, for example.

Logistically, the antenna system should be robust in design and easy to produce in large quantities using proven methods. The antenna system should have excellent maintainability features. All components of the antenna system should be readily accessible, standardized and easily replaced. Also, the antenna system should function in severe outdoor environments.

It would therefore be desirable to have a low cost antenna system for use with user subscriber terminals used to communicate with low-earth orbiting satellites. Accordingly, it is an objective of the present invention to provide for a very small antenna terminal (VSAT) antenna system for use with user subscriber terminals and which may be used to communicate with low-earth orbiting and other satellites.

SUMMARY OF THE INVENTION

To accomplish the above and other objectives, the present invention provides for an improved very small antenna terminal (VSAT) dual-beam antenna system. The antenna system is designed for use with user subscriber terminals that communicate with low-earth orbiting (LEO) and other communication satellites.

The dual-beam antenna system uses two offset Gregorian dual-reflector antennas. Each offset Gregorian dual-reflector antenna comprises an ellipsoidal subreflector, and a rotatable paraboloidal reflector having a focus in common with a focus of the ellipsoidal subreflector. The rotatable paraboloidal reflector couples energy to and from the ellipsoidal subreflector. An RF feed system is provided that couples RF energy to and from the ellipsoidal subreflector.

Rotating apparatus is provided that rotates the paraboloidal reflector and ellipsoidal subreflector together around an azimuth axis of the antenna. The rotating apparatus independently and simultaneously rotates the paraboloidal reflector about an axis between the paraboloidal reflector and ellipsoidal subreflector which points the antenna at an orbiting satellite.

A controller is coupled to the rotating apparatus that controls rotation of the paraboloidal reflector and the antenna to point the antenna toward the orbiting satellite. The controller provides commands to the actuators that automatically track movement of the low earth orbiting satellites. The antennas are configured specifically to operate in 20 and 30 GHz frequency bands allocated for use by the low earth orbiting satellites.

The antenna system may also include a low-loss A-sandwich radome. The A-sandwich radome preferably has a thick core configuration that doubly-tunes the radome wall for optimum performance in 20 GHz and the 30 GHz frequency bands.

The ellipsoidal subreflector and paraboloidal reflector of each of the antennas are offset and arranged so that paraboloidal reflector rotates about a central ray axis of the antenna. This causes the paraboloidal reflector to scan a beam in a cone about the central ray axis with corresponding motion in elevation and azimuth.

The rotating apparatus rotates the ellipsoidal subreflector and paraboloidal reflector together about a vertical axis of the antenna thereby scanning a beam in an upper hemispherical cap. The rotating apparatus preferably uses stationary actuators for rotating the ellipsoidal subreflector and paraboloidal reflector. The first and second actuators are sinmultaneously driven in such a way that the antenna beam is pointed at a desired angle in the upper hemisphere.

The RF feed system is preferably a dual-frequency dual circular polarization feed system which may include a solid-state polarization switch for selecting a desired polarization sense. The RF feed system of each antenna is coupled to a microwave VSAT radio having a receiver and transmitter a that operate in the 20 and 30 GHz frequency bands, respectively.

The two offset Gregorian dual-reflector antennas are preferably mounted side-by side and the controller coupled to one antenna causes it to be pointed at a first satellite while the controller coupled to the second antenna causes it to track a rising satellite. The VSAT radio is automatically handed-off to the rising LEO satellite by switching the VSAT radio from the one antenna to the second antenna. Typical LEO systems limit the lowest elevation angle to about 37 degrees.

Another embodiment of the antenna system may be used to track a single inclined-orbit satellite having a figure-eight orbit when viewed from the Earth. The path motion of these satellites is relatively slow and is limited to several degrees of angular deviation. In tracking such inclined-orbit satellites, the actuator move the antenna more slowly. Furthermore, only one antenna system is required to track the satellite.

Another embodiment of the antenna system may be used as a fixed-site antenna system. A single antenna system is oriented in a fixed direction, without using actuators. The antenna system is manually oriented at the desired elevation and azimuth angles. The orientations of the offset paraboloidal reflector and offset ellipsoidal subreflector are fixed, and the base plate is also fixed (nonrotating). In this embodiment, the RF feed system is fixed to the base plate and unitized with the VSAT radio. This reduces the overall height of this embodiment of the antenna system below that of a standard VSAT arrangement.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which.

DETAILED DESCRIPTION

Figure 1:
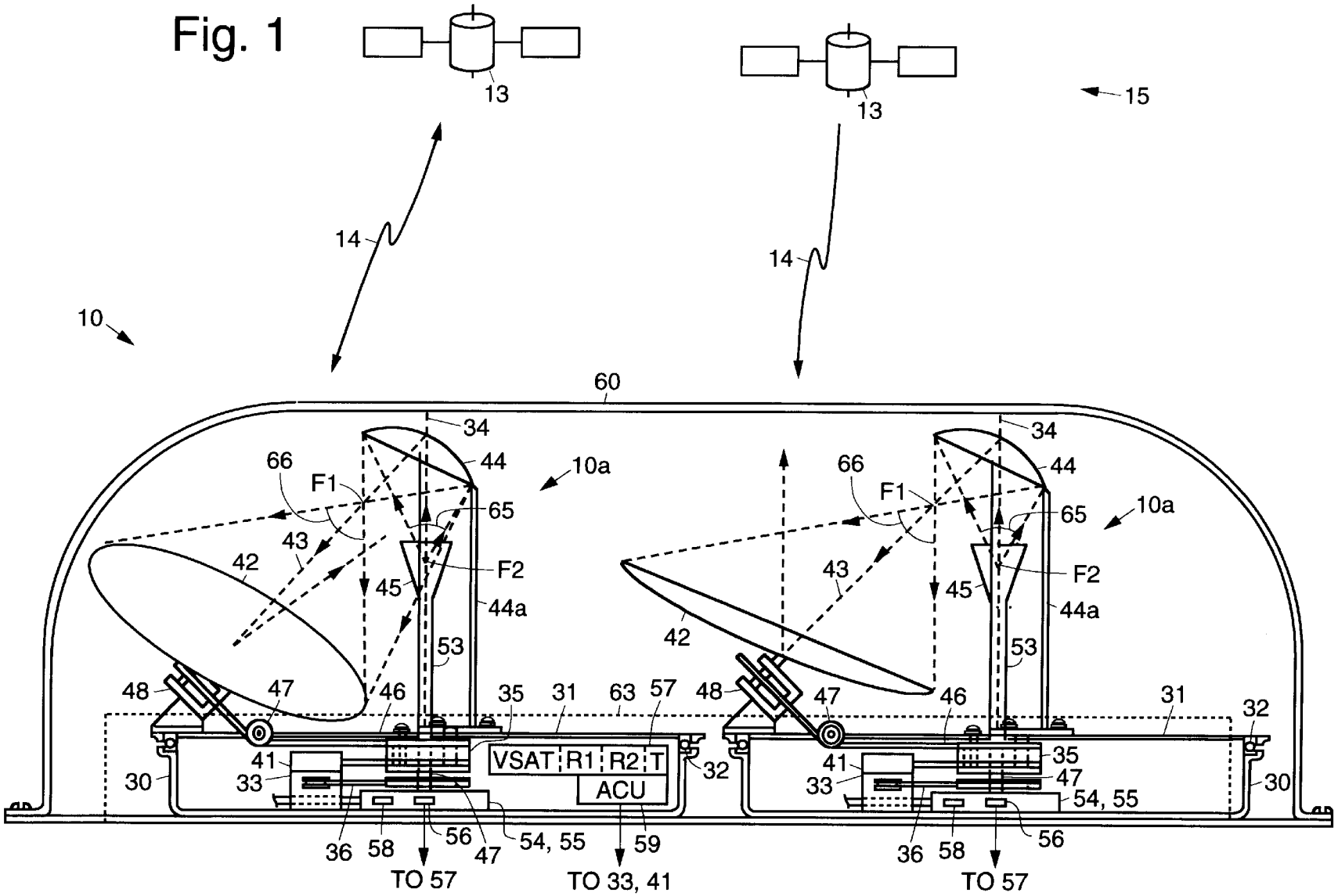
FIG. 1 illustrates a cross sectional side view of a dual-beam antenna system in accordance with the principles of the present invention.
Figure 2:
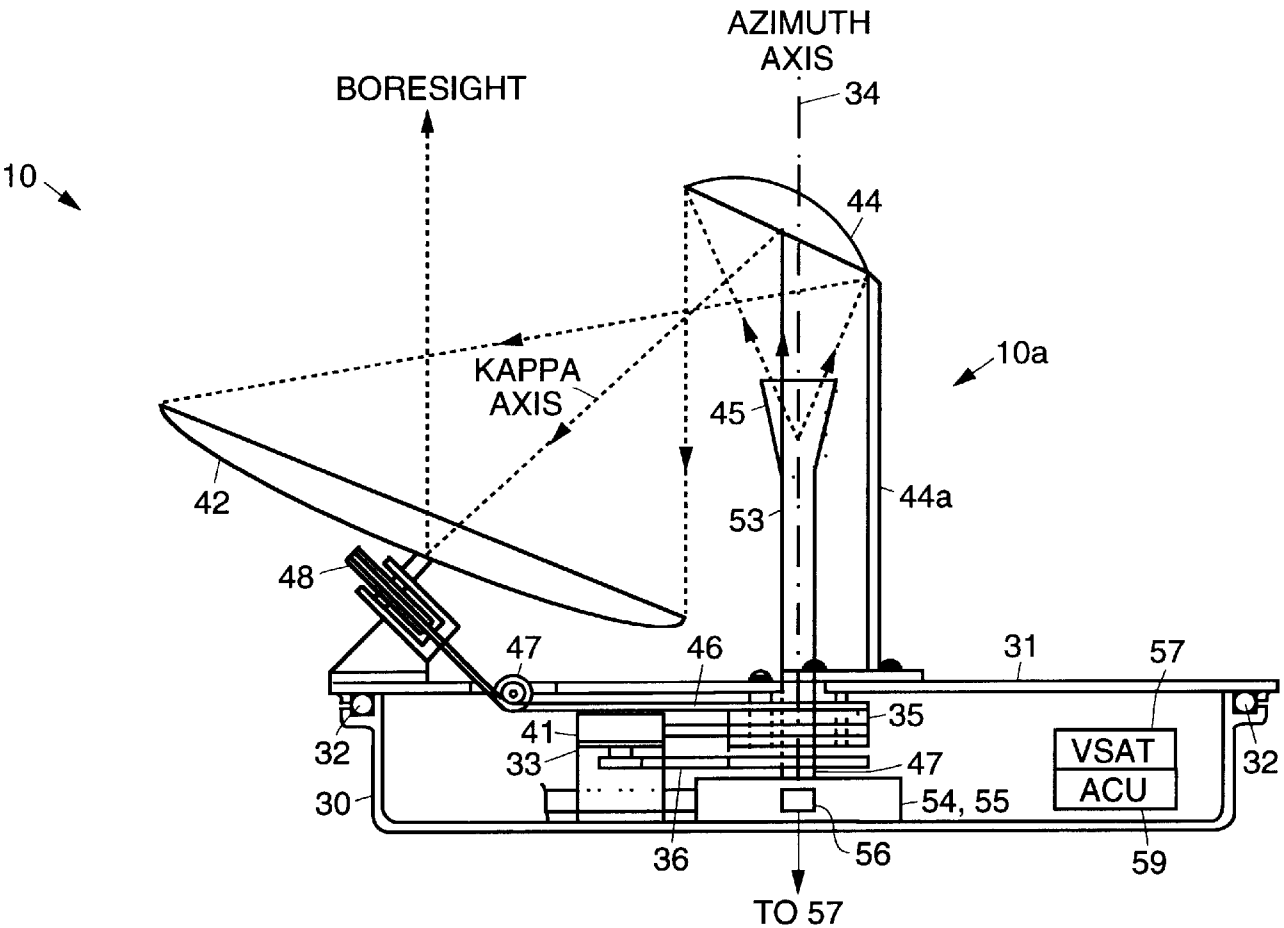
FIG. 2 illustrates a cross sectional side view of one of the Gregorian antenna systems depicted in FIG. 1 showing boresight at 90° elevation and 0° azimuth.
Figure 3:
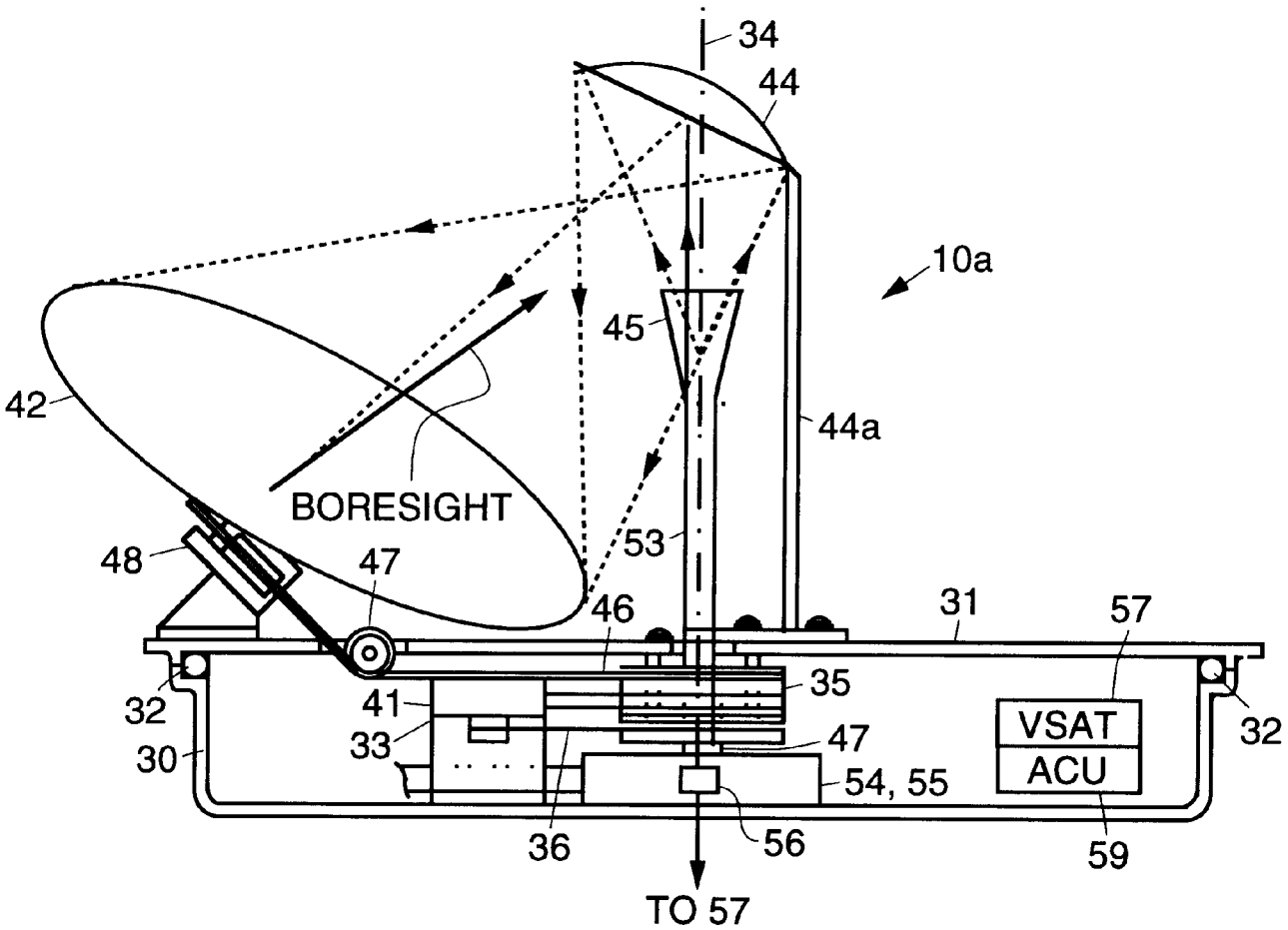
FIG. 3 illustrates a cross sectional side view of one of the Gregorian antenna systems depicted in FIG. 1 showing boresight at 37° elevation and 0° azimuth.
Figure 4:
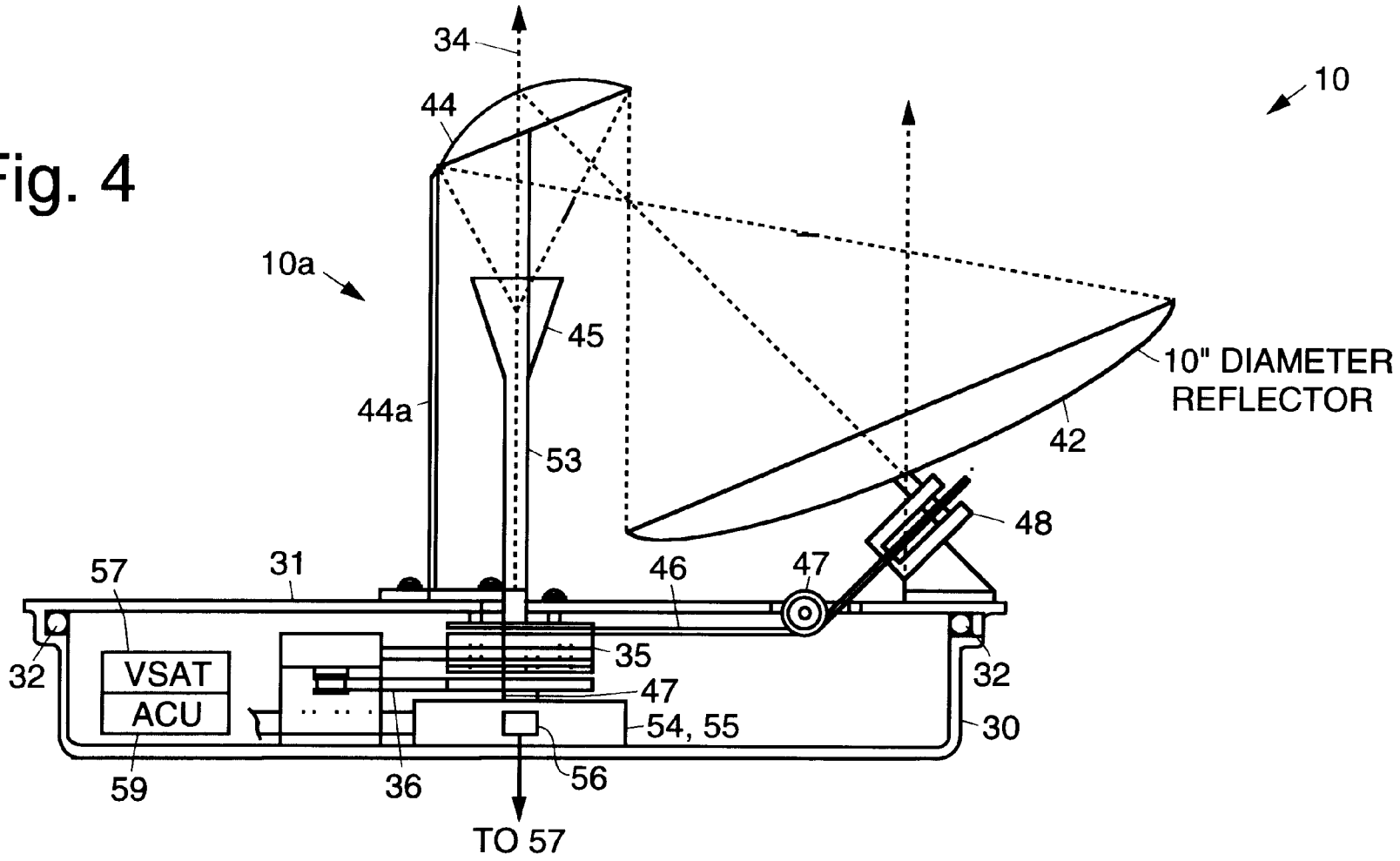
FIG. 4 illustrates a cross sectional side view of one of the Gregorian antenna systems depicted in FIG. 1 showing boresight at 180° azimuth.
Figure 5:
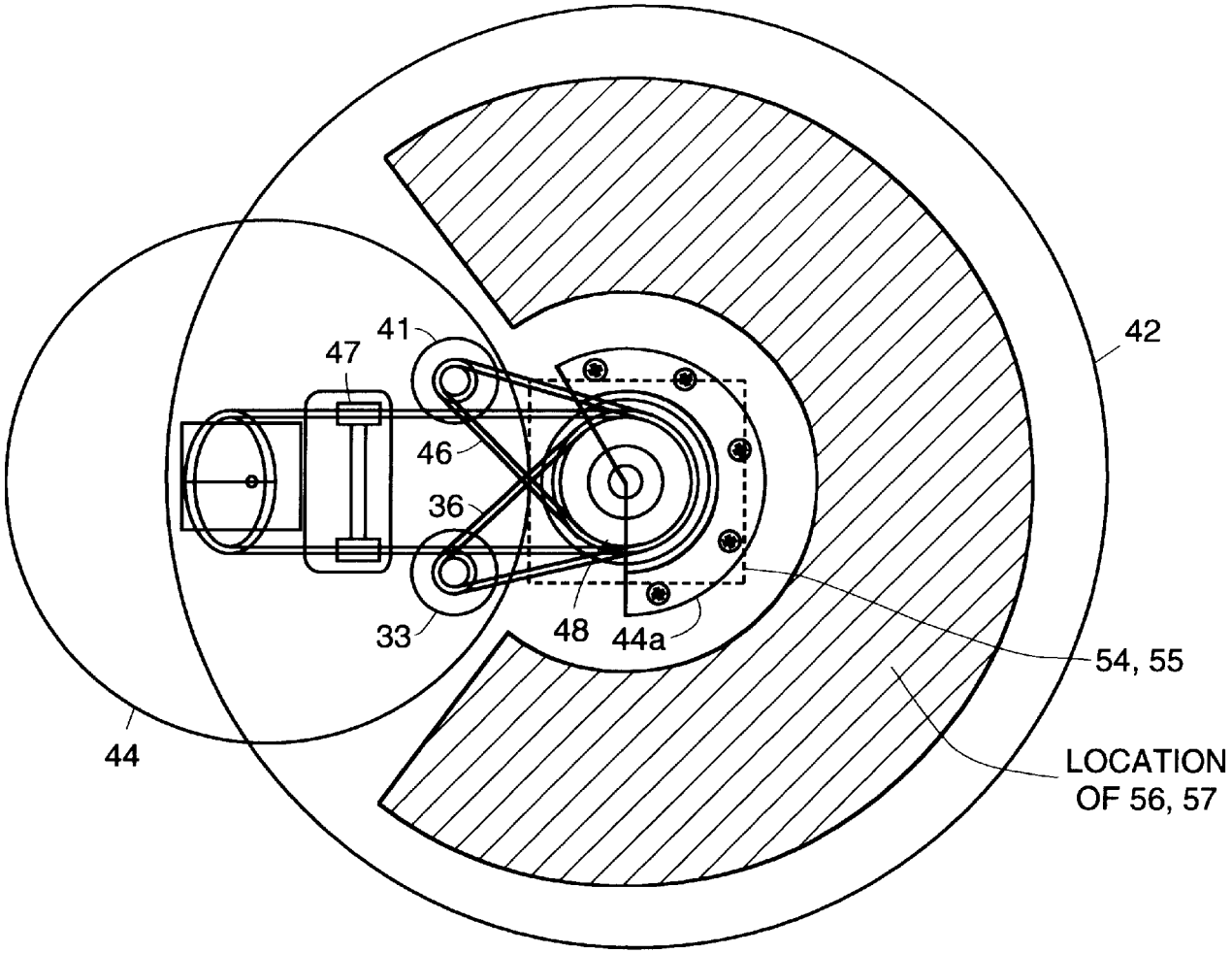
FIG. 5 illustrates a top plan view showing one of the Gregorian antenna systems used in the antenna system of FIG. 1.

Referring to the drawing figures, FIG. 1 illustrates a dual-beam antenna system 10 comprising two Gregorian dual-reflector antenna systems 10*a* in accordance with the principles of the present invention. FIG. 2 illustrates a cross sectional side view of one of the Gregorian antenna systems 10*a* depicted in FIG. 1 showing boresight at 90° elevation and 0° azimuth. FIG. 3 illustrates a cross sectional side view of one of the Gregorian antenna systems 10*a* depicted in FIG. 1 showing boresight at 37° elevation and 0° azimuth. FIG. 4 illustrates a cross sectional side view of one of the Gregorian antenna systems 10*a* depicted in FIG. 1 showing boresight at 180° azimuth. FIG. 5 illustrates a top plan view showing one of the Gregorian antenna systems 10*a* used in the antenna system 10 of FIG. 1.

The dual-beam antenna system 10 comprises two independent, but identical Gregorian antenna systems 10*a,* each of which comprises an offset Gregorian antenna 10*a*. The respective antennas 10*a* are typically pointed toward orbiting low earth orbit (LEO) satellites 13. Two independent beams 14 are required to communicate with the LEO satellites 13. One beam 14 is generated by a first antenna system 10*a* that tracks an active satellite 13 while transmitting and receiving. A second beam 14 is generated by a second antenna system 10*a* that anticipates the angular position of a rising satellite 13 and is coupled to a first receiver (R1) of a VSAT radio 57 that functions to acquire the next rising satellite 13 that is to be communicated with. Upon hand-off to the next rising satellite 13, a transmitter (T) and a second receiver (R2) of the VSAT radio 57 coupled to the second antenna system 10*a* are switched to the rising satellite 13 and the cycle is repeated.

Each offset Gregorian antenna 10*a* has a housing 30 coupled to a rotatable base plate 31 by means of an azimuth bearing 32. Each offset Gregorian antenna 10*a* comprises an offset paraboloidal reflector 42 and an offset ellipsoidal subreflector 44. The offset ellipsoidal subreflector 44 is coupled to the base plate 31 by means of a support column 44*a*.

An azimuth axis stepper motor 33 or actuator 33 is coupled to the base plate 31 that is used to rotate the base plate 31 relative to the fixed housing 30 around an azimuth axis 34 of the antenna 10*a*. Rotation is achieved using an azimuth axis drive system 35 coupled to the azimuth axis stepper motor 33 by way of a timing belt 36. A kappa axis stepper motor 41 or actuator 41 is coupled to the base plate 31 which is used to rotate an offset paraboloidal reflector 42 around a kappa axis 43 of the antenna 10*a*. The kappa axis 43 is defined as an axis along a line between the center of the offset ellipsoidal subreflector 44 and the center of the offset paraboloidal reflector 42. Rotation is achieved using a kappa axis drive system 48 coupled to the kappa axis stepper motor 41 by way of timing belts 46.

Each offset Gregorian antenna 10*a* has first and second focal points (F1, F2). The first focal point (F1) corresponds to second Gregorian focus of the offset ellipsoidal subreflector 44. The second focal point (F2) corresponds to a first Gregorian focus of the offset ellipsoidal subreflector 44. The offset ellipsoidal subreflector 44 is supported by a support column 51 that is secured to the base plate 31. A (corrugated) conical feedhorn 45 has its phase center located at the second focal point (F2) of the offset ellipsoidal subreflector 44. The conical feedhorn 45 is coupled by way of a circular waveguide 53 to a diplexer 54 and polarizer 55 having an RF interface 56 that interfaces to a VSAT radio 57.

The offset paraboloidal reflector 42 of each offset Gregorian antenna 10*a* is also offset from the azimuth axis 34 of the antenna 10*a*. The offset paraboloidal reflector 42 is secured to the rotatable base plate 31. The offset paraboloidal reflector 42 is rotatable around the kappa axis 43, which is a line extending between respective centers of the offset ellipsoidal subreflector 44 and the offset paraboloidal reflector 42. Rotation is achieved using the kappa axis drive system 48 coupled to the kappa axis stepper motor 41 by way of a timing belt 46.

The offset paraboloidal reflector 42 has a first focal point that coincides with the first focal point of the offset ellipsoidal subreflector 44. The first focal points of the offset paraboloidal reflector 42 and the offset ellipsoidal subreflector 44 lie along the kappa axis 43. The locations of the respective first focal points of the offset ellipsoidal subreflector 44 and offset paraboloidal reflector 42 are also located along a line that extends between adjacent edges of the offset ellipsoidal subreflector 44 and offset paraboloidal reflector 42.

The offset paraboloidal reflector 42 and the offset ellipsoidal subreflector 44 are rotated around the azimuth and kappa axes 34, 43, respectively in a controlled manner to accurately point the antenna 10*a* at a desired orbiting satellite 13. Again, one antenna 10*a* is pointed toward an active orbiting satellite 13 and tracks the active satellite 13 while transmitting and receiving, and the second antenna 10*a* anticipates the angular position of and has its receiver functioning to acquire the next rising satellite 13.

In the antenna system 10, the fundamental focussing properties of the offset Gregorian antenna 10*a* are used to advantage. The physics relating to the present antenna system 10 is summarized below. Referring again to FIG. 1, it shows the geometry of the antenna system 10.

In operation, a first circular cone 65 of rays emanates from the feedhorn 45 whose phase center is at the first Gregorian focus (F2). The axis of this first ray cone 65 is vertical (parallel to a vertical axis 34). The first ray cone 65 illuminates the offset ellipsoidal subreflector 44. The first ray cone 65 reflects from the offset ellipsoidal subreflector 44 and is refocused as a second ray cone 66 whose apex is the second Gregorian focus (F1). The second Gregorian focus (F1) is coincident with the prime focus of the offset paraboloidal reflector 42. The angle that the axis of the second ray cone 66 makes relative to the vertical axis 34 is designated as kappa. The second ray cone illuminates the offset paraboloidal reflector 42.

Figure 6:
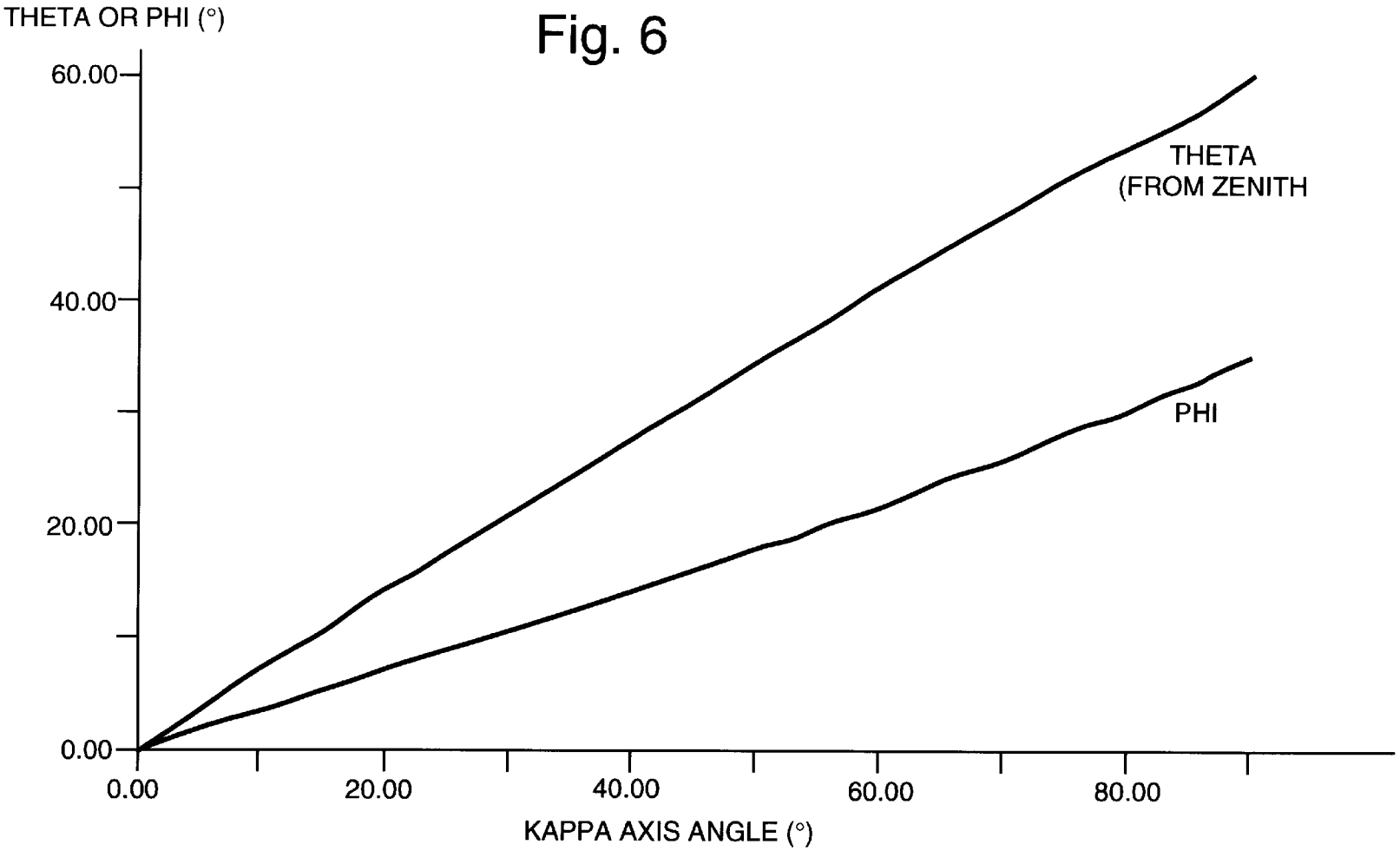
FIG. 6 shows graphs of the elevation and azimuth main beam angles against kappa axis rotation angle for kappa=45 degrees for the system of FIG. 1.

The offset paraboloidal reflector 42 collimates the second ray cone 66 into a plane wave perpendicular to a main beam direction (the boresight axis shown in FIG. 2). This results in a secondary radiation pattern whose beam is along the boresight axis. The kappa axis stepper motor 41 rotates the offset paraboloidal reflector 42 about the kappa axis 43, and the main beam nutates about the vertical axis 34. If this is done while the prime focus of the offset paraboloidal reflector 42 is coincident with F1, then perfect collimation occurs for any kappa rotation. FIG. 6 shows graphs of the elevation and azimuth main beam angles against the kappa axis rotation angle for kappa=45 degrees.

For example, a rotation of 78.3 degrees about the kappa axis scans the beam from zenith down to 37 degrees elevation. This rotation also results in a 29.9 degree change in azimuth.

The azimuth axis stepper motor 33 rotates the offset paraboloidal reflector 42 and the offset ellipsoidal subreflector 44 together about the vertical feed axis 34 using a fixed feed 45. This combination of rotations allows for complete hemispherical beam coverage above 37 degrees elevation. However, in principal, the beam can be scanned to the horizon or even below the horizon.

Since the offset paraboloidal reflector 42 is always focussed for any rotation about the kappa axis 43 and always presents a circular projected aperture to the second cone 66 of rays coming from second Gregorian focus (F1), the main beam shape never changes by scanning in this manner. Beamwidths and sidelobes are invariant with rotation about both the vertical axis 34 (azimuth axis 34) and the kappa axis 43.

The end result is a simple microwave beam scanning arrangement ideally suited for upper hemisphere coverage for use with the user subscriber terminals of a low earth orbiting communications satellite system 15 employing low earth orbiting communication satellites 13. In the exemplary design, no active mechanical or microwave components are rotated and all interfaces are completely fixed with resulting advantages.

The above description discusses the optics of the antennas 10*a* used in the antenna system 10. While there are other factors such as diffraction and aperture blockage (for some geometries) which may affect performance, these factors have been analyzed and do not substantially affect the overall performance of the antenna system 10.

For the purposes of completeness, typical performance requirements of an exemplary antenna system 10 are summarized below. The antenna system 10 functions to receive data transmitted from two satellites 13 and transmit data to either of the satellites 13. The number of beams comprises two (independent) beams. The transmit bandwidth is 28.6–29.1 GHz, with 36 dBic gain and a 3.0 degree beamwidth. The receive bandwidth is 18.8–19.3 GHz, with 32 dBic gain, and 4.5 degree beamwidth and a figure of merit of +7.0 dB/K G/T. The polarization of the antenna system 10 is co-polarization or orthogonal-polarization RHCP or LHCP, which polarization state is selectable in 3.5 microseconds. Cross-polarization of the antenna system 10 is 25 dB, minimum, (axial ratio 1.03 dB maximum). The isolation is 80 dB between receive and transmit beams. The sidelobes are −27 dB maximum. The transmit power is 11 dBW, nominal. Pointing of the antenna system 10 has a 0.5 dB pointing loss, tracks at 0.25 degrees/second, acquires a satellite in 60 seconds, has a maximum elevation of 90 degrees and a minimum elevation of 37 degrees, and switches satellites 13 in 3.5 microseconds. The antenna system 10 has a radome 60 with a 0.2 dB maximum loss. The dimensions of a reduced to practice embodiment of the antenna system 10 are 16" high, 20" wide, and 36" long. 12V DC power is provided for steering the antenna system 10. The antenna system 10 is designed to be operational in winds to 50 MPH, and survive 125 MPH winds. The antenna system 10 is operational at temperatures from −40 degrees C. to +55 degrees C. The environmental design of the antenna system 10 permits unattended outdoor usage.

The antenna system 10 described herein uses two identical and independent inverted offset Gregorian dual-reflector antenna systems 10*a*. One antenna system 10*a* communicates with one satellite 13 while the other antenna system 10*a* stands by to communicate with a new rising satellite 13. The feed axis 34 of each antenna system 10*a* is vertical. The conical feedhorn 45 illuminates the offset ellipsoidal subreflector 44 and the offset ellipsoidal subreflector 44 illuminates the offset paraboloidal main reflector 42.

The beam is pointed anywhere in an upper spherical cap by rotating about two non-orthogonal (coupled) axes. One axis is the feedhorn axis, about which the beam rotates in azimuth. The feedhorn is stationary. The second axis, designated as the kappa axis, is tilted with respect to the vertical and is formed by a central ray axis in the microwave optics system. The inclination of the kappa axis in a typical antenna design is about 45 degrees.

Rotation of the main offset paraboloidal reflector 42 about the kappa axis rotates the beam in a conical motion about the central ray axis. The kappa and azimuth axes are non-orthogonal so that both are driven when a predefined elevation and azimuth beam position is desired. This is readily done using software that controls the corresponding actuators 33, 41 (stepper motors 33, 41).

In this coordinate geometry, a rotation of 78 degrees about the kappa axis nutates the beam 53 degrees down from zenith (to 37 degrees elevation above the horizon). In this position, the beam's azimuth has also rotated by about 30 degrees. This azimuth motion is compensated by suitable rotation of the azimuth axis by the azimuth actuator 33.

The azimuth actuator 33 rotates the entire upper assembly (offset ellipsoidal subreflector 34 and main offset paraboloidal reflector 42) about the vertical axis 34. The actuators 33, 41 for the azimuth and kappa axes are located on the lower, fixed base 31 of the antenna system 10. The actuators 33, 41 are fixed to the antenna base plate 31. Therefore, no cable wraps or slip rings are necessary to move the upper assembly. The upper assembly may be embodied as a single unitized, passive, lightweight molded plastic structure with metallization on the front surfaces of the microwave ellipsoidal and paraboloidal reflectors.

Rotation about the feedhorn axis does not change the antenna gain or beam pattern since the feedhorn pattern is rotationally symmetrical. Likewise, rotation about the kappa axis does not change the gain or beam pattern because the scatter pattern of the feedhorn 45 and offset ellipsoidal subreflector 44 is also rotationally symmetrical. Since the feedhorn 45 is circularly polarized, mechanical motion of the two reflectors 42, 44 in this manner does not change the polarization.

In this innovative manner, complete beam coverage of the upper spherical cap is achieved with a simple passive scanning system. Stepper motors 33, 41 are preferably used for the two actuators 33, 41. The azimuth stepper motor 33 drives an azimuth shaft 47 using the timing belt 36 or equivalent. The kappa-axis motor 41 drives its axis using the timing belt 46 or equivalent running over a set of idlers 47, for example.

Since the kappa-axis motor 41 is fixed, a rotation in azimuth also changes the kappa rotation angle. This motion may be readily compensated for using software and controlling the manner in which both motors 33, 41 are driven. Both mechanical axes may incorporate simple encoders.

The motor/encoder subassembly is designed as a robust unitized package with easy maintainability features. Motors 33, 41, bearings 32 and timing belts 36, 46 or their equivalents are sized for reliable operation for extended usage. A product lifetime of many years is thereby assured.

The feed system for the antenna systems 10*a* include the broadband, corrugated conical feedhorn 45 which produces a Gaussian-type primary radiation pattern. The feedhorn 45 with its circular waveguide 53 is fixed to a microwave subassembly including the diplexer 54 and polarizer 55. In a reduced to practice embodiment, the microwave subassembly contains a circular polarizer 55 and a four-port diplexer 54. A fast RF switch 58 may be used to select either RHCP or LHCP. In this scheme, independent selection of polarization sense is done for both receive and transmit functions. This results in maximum VSAT system utility.

An antenna control unit (ACU) 59 using satellite ephemeris data commands the two actuators 33, 41 of each antenna system 10*a*. The antenna control unit 57 is located in the base area. The antenna system 10 is aligned by a technician to North at installation. This is done by simple rotation of the entire antenna system 10 since each antenna 10*a* is designed to be pinned to a common base plate 31. The radome 60 may comprise a low-loss A-sandwich radome 60 that is placed over the entire antenna system 10. The A-sandwich radome 60 is designed to have a thick core configuration that doubly-tunes the wall of the radome 60 for optimum performance in 20 GHz and the 30 GHz frequency bands that are used for receiving and transmitting, respectively.

Figure 7:
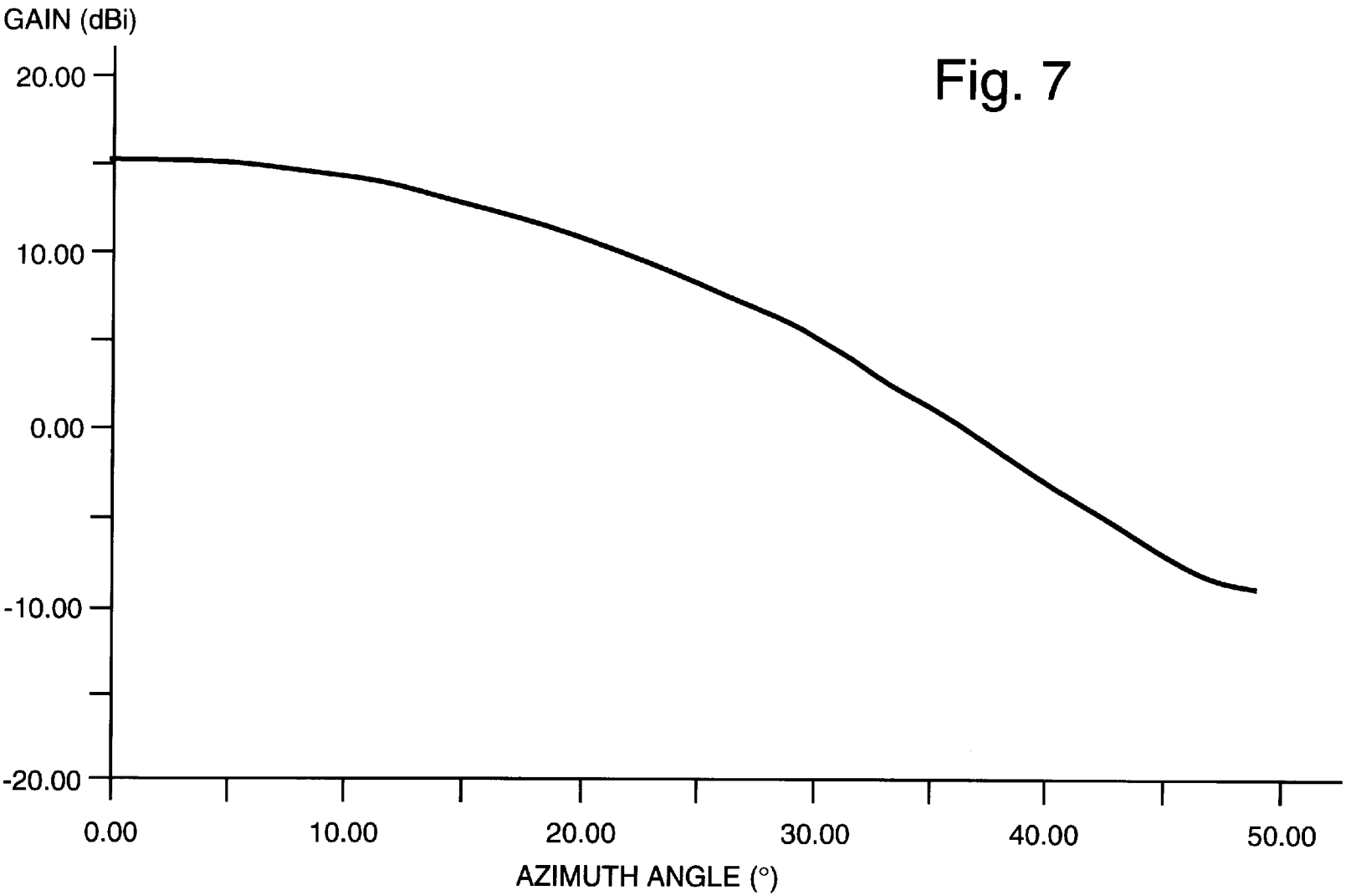
FIGS. 7 and 8 depict radiation patterns of the feedhorn at 19.1 GHz and 28.5 GHz, respectively.
Figure 8:
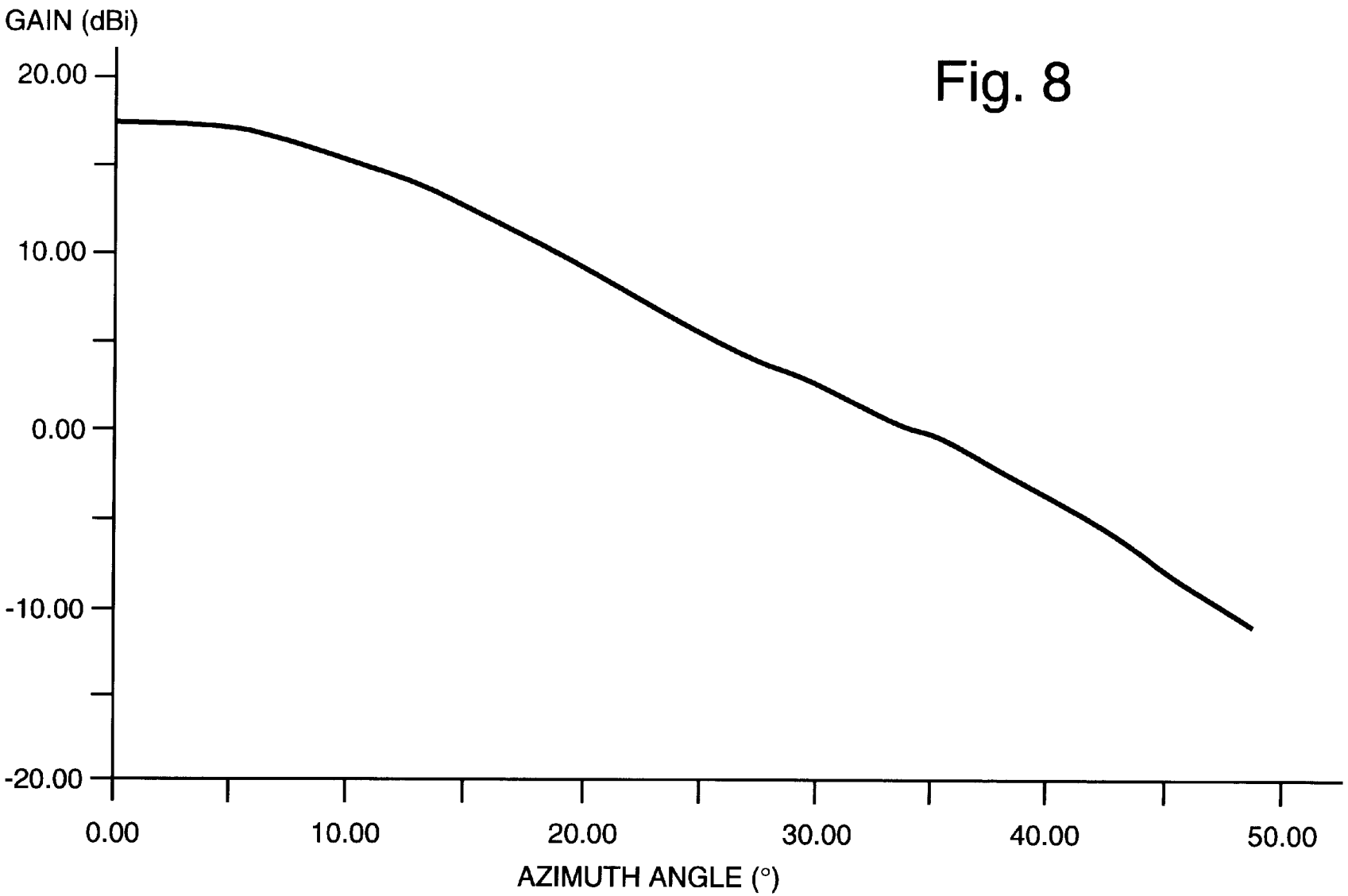
Figure 9:
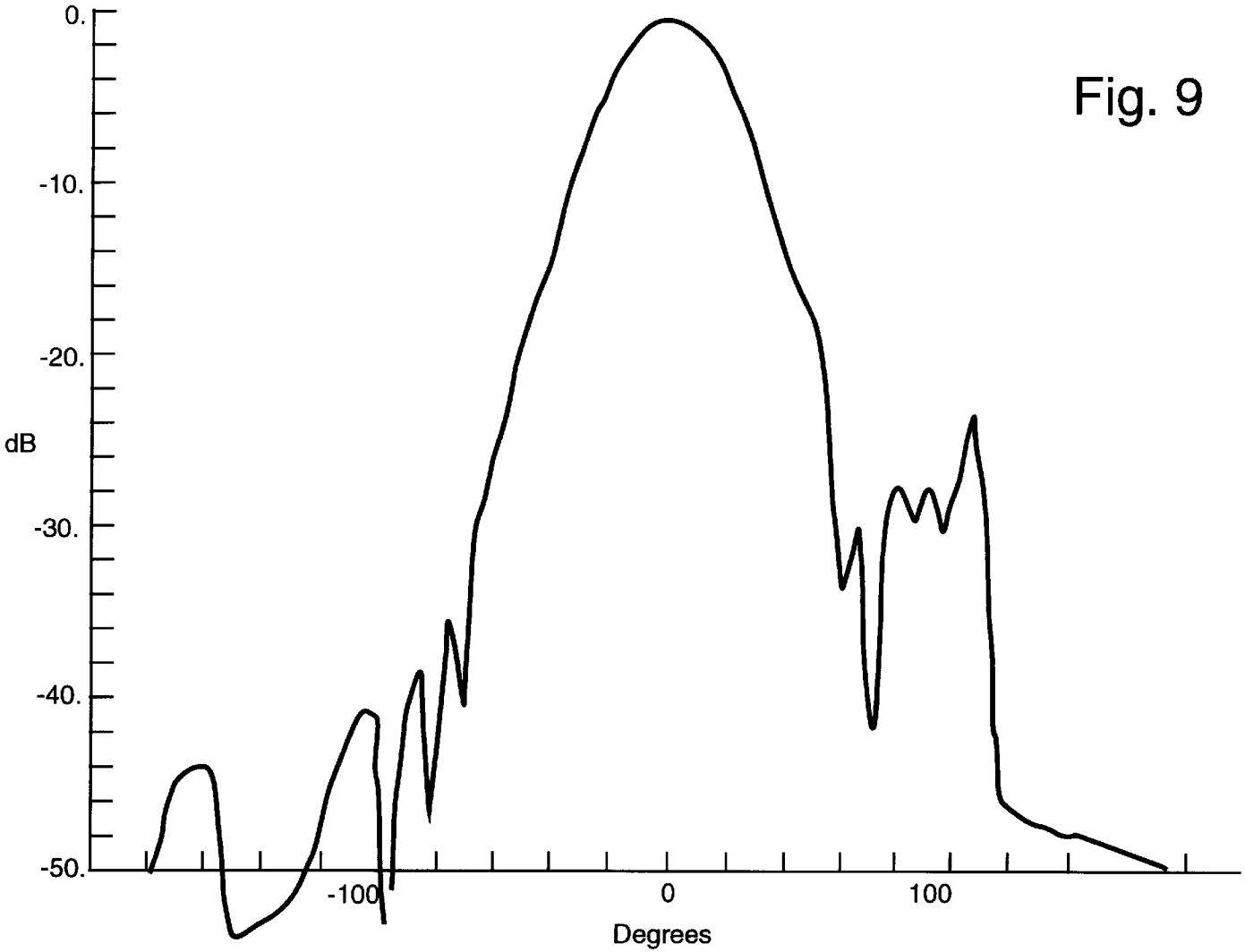
FIG. 9 shows a typical scatter pattern of an offset ellipsoidal subreflector when fed with a feedhorn.
Figure 10:
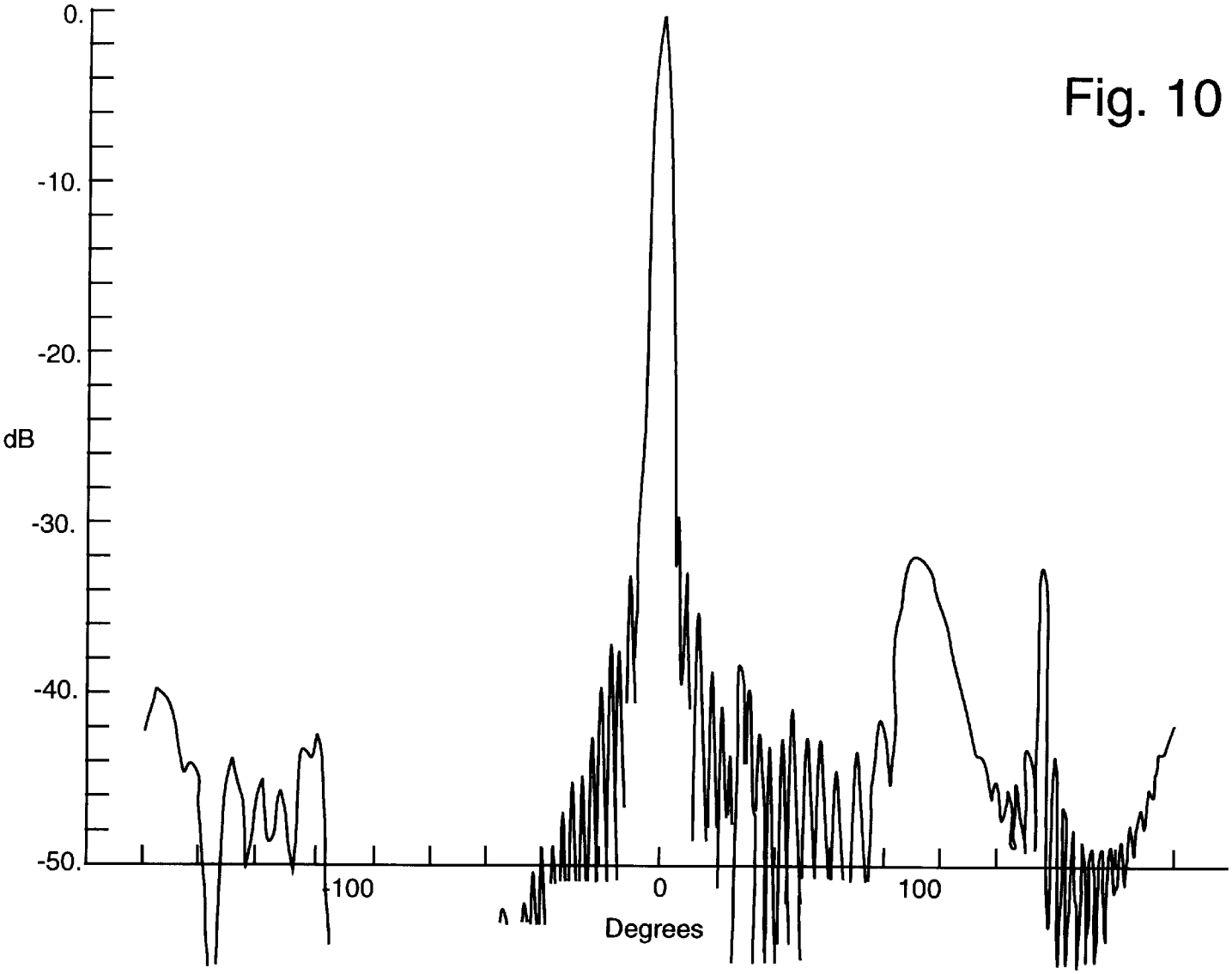
FIGS. 10, 11, 12 and 13 show secondary patterns of the antenna system at receive and transmit midband frequencies.
Figure 11:
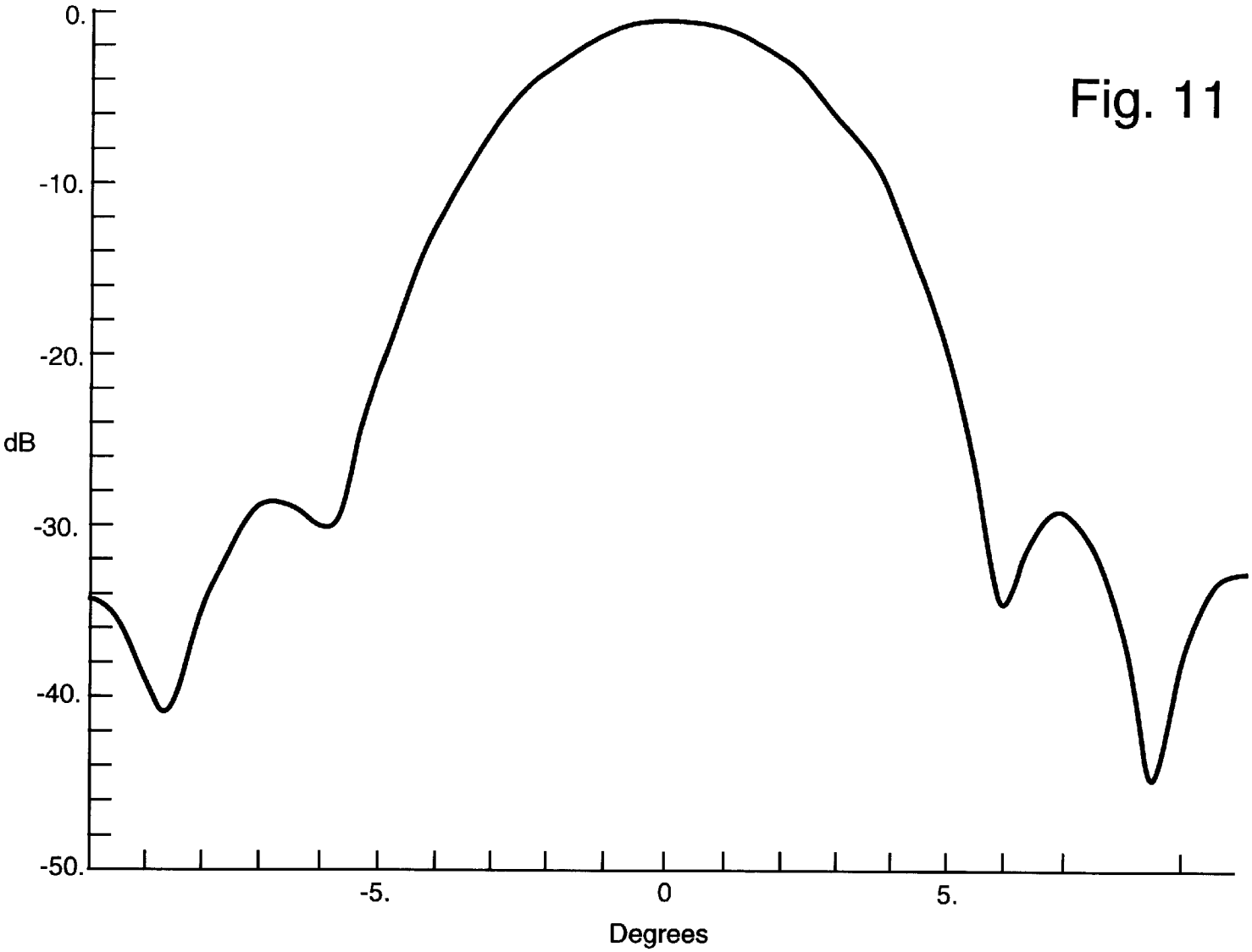
Figure 12:
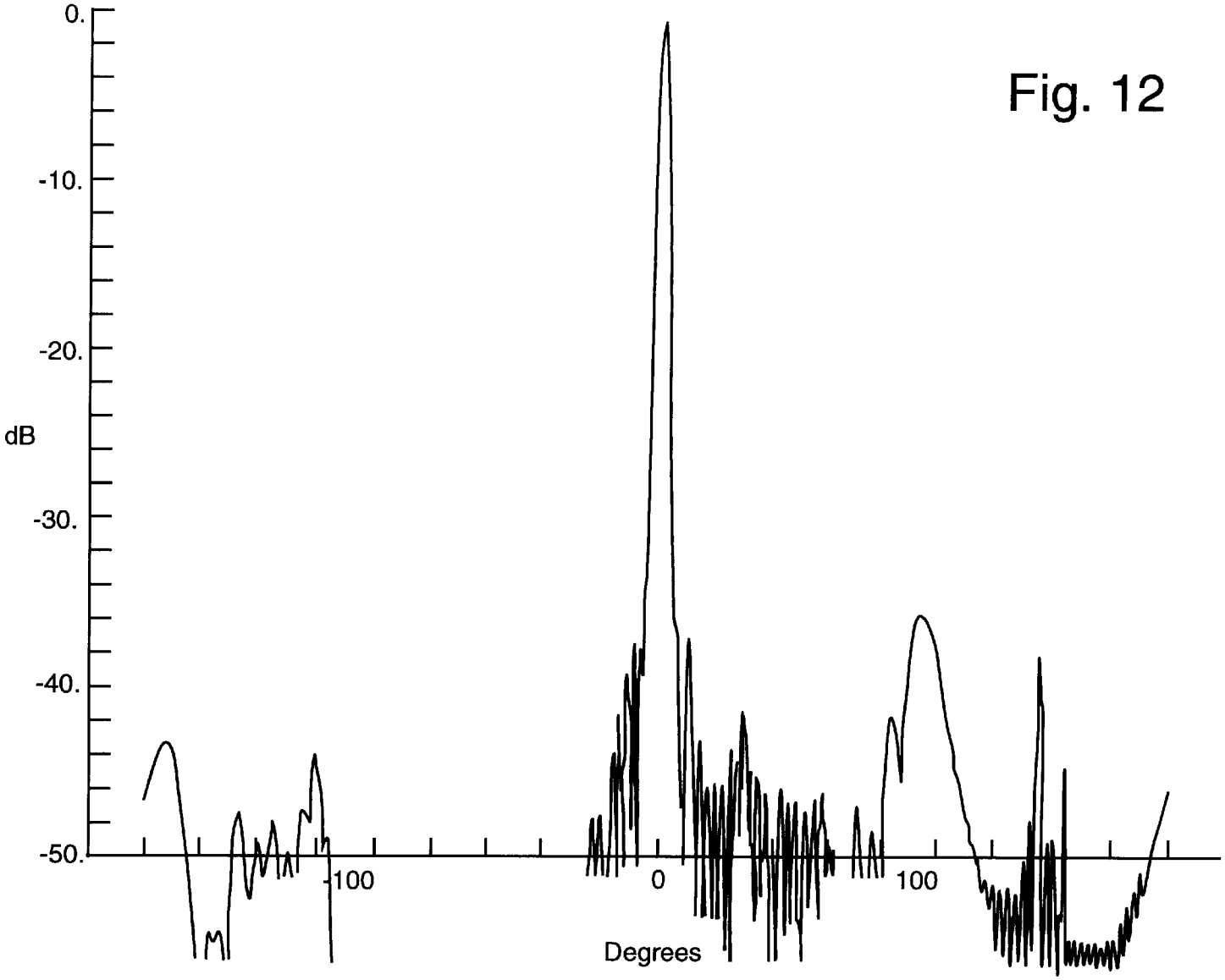
Figure 13:
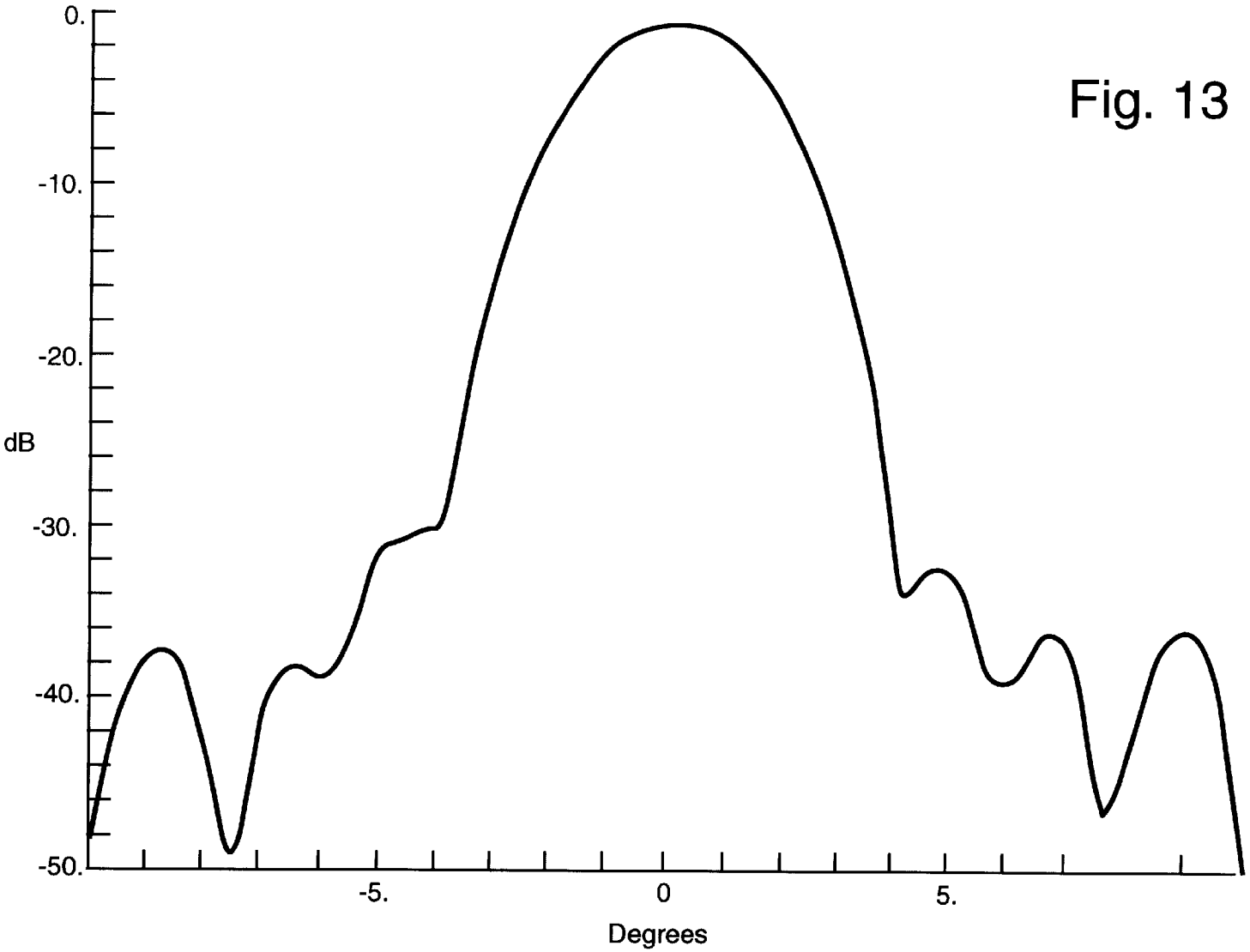

Antenna gain and pattern performance for an exemplary reduced to practice embodiment of the antenna system 10 will now be described. FIGS. 7 and 8 depict radiation patterns of the feedhorn 45 at 19.1 GHz and 28.5 GHz, respectively. FIGS. 7 and 8 verify that the feedhorn 45 is well-designed for illuminating the offset ellipsoidal subreflector 44 of shown in FIG. 1. FIG. 9 shows a typical scatter pattern of the offset ellipsoidal subreflector 44 when fed with the feedhorn. This illustrates the rotationally symmetrical scatter pattern for illuminating the offset paraboloidal reflector 42. FIGS. 10, 11, 12 and 13 show secondary patterns of the antenna system 10 at receive and transmit midband frequencies.

Figure 14:
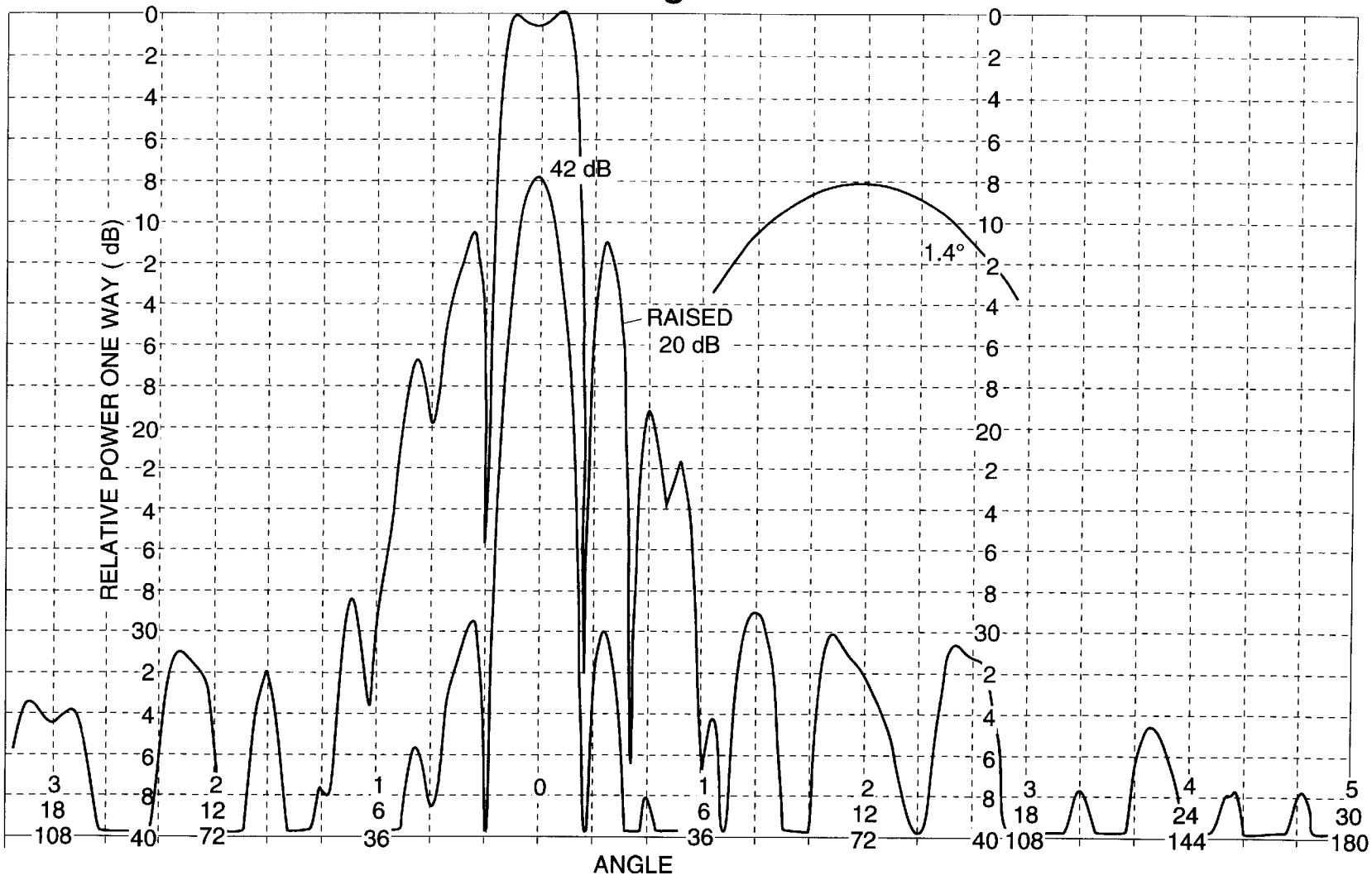
FIG. 14 shows graphs of relative power versus angle for the dual-beam antenna system of FIG. 1.

FIG. 14 shows a graph of relative power versus angle for the dual-beam antenna system 10 of FIG. 1. The right-hand trace is taken with reference to the uppermost angular scale. The other two traces are taken with reference to the middle angular scale. These two traces show the main beam with two receiver gain settings. One trace depicts the top of the main beam. The trace labeled "raised 20 dB" is the same pattern with the receiver gain increased by 20 dB to depict lower level sidelobes. FIG. 14 thus illustrates the same pattern.

| | The following radiating properties can be summarized from these data: | | | |
|---|---|---|---|---|
| Band | Frequency GHz | Gain dBic | Beamwidth Degrees | Sidelobe dB |
| Receive | 19.1 | 32.8 | 4.3 | −28.0 |
| Transmit | 28.5 | 36.4 | 2.9 | −29.8 |

These values comply with requirements for typical low earth orbit satellite communications systems 15. Because of the offset reflector design, the low sidelobes minimize the antenna noise temperature.

Significant features of the antenna system 10 are that it achieves scanning with passive reflectors (paraboloidal subreflector 42 and ellipsoidal subreflector 44). There are no RF rotary joints or moving waveguides. There are no slip rings or cable wraps. The antenna system 10 uses two major lightweight, unitized moving parts. The antenna system 10 uses an all-polarization feed system. The antenna system 10 has a on-blocked radiating aperture. The antenna system 10 has a low sidelobe offset reflector geometry. The antenna system 10 has a low center of mass. The antenna system 10 has a drive motor package that is unitized for reliability and cost. The antenna system 10 has a reasonably compact geometry and swept volume. The antenna system 10 complies with typical LEO requirements and has a robust design.

The feed and diplexer assemblies may be investment cast, unitized and easily interfaced to the associated electronic equipment. Because the feed and diplexer assemblies are in an accessible location, they are readily removed and replaced. A side access panel 63 in the radome 60 may be provided as a service access for the antenna system 10. The design allows the access panel 63 to be outside the RF window area. The antenna system 10 is designed to employ a lightweight reflector assembly using metallized molded plastic components. The radome 60 is a low-loss radome.

The present antenna system 10 may also be used to track a single inclined-orbit satellite 13. Such inclined-orbit satellites 13 have "figure-eight" orbits when viewed from the Earth. Some geosynchronous satellite constellations deliberately allow satellite motion to conserve stationkeeping fuel and extend satellite lifetimes. The orbital paths of these satellites 13 are tracked by the antenna system 10*a,* but the path motion is relatively slow (hours) and limited (several degrees). In tracking such inclined-orbit satellites 13, the motors 33, 41 would simply move the antenna 10*a* more slowly to track the satellite 13. Furthermore, only one antenna system 10*a* is required to track the satellite 13.

Another embodiment of the present antenna system 10 may be used as a fixed-site antenna system 10. The fixed-site antenna system 10 comprises a single antenna system 10*a* oriented in a fixed direction (i.e., without the actuators 33, 41 or motors 33, 41). A single antenna system 10*a* is used that is manually adjusted to be oriented at the desired elevation and azimuth angles. The desired elevation and azimuth are fixed using brackets, for example, to fix the orientation of the offset paraboloidal reflector 42. The offset ellipsoidal subreflector 44 is fixed and to the base plate 31, which in this embodiment is also fixed (nonrotating).

In this embodiment of the antenna system 10 the RF feed system is fixed to the base plate 31 and unitized with the VSAT radio 57. Thus, the overall height of this embodiment of the antenna system 10 may be reduced below that of a standard VSAT arrangement, which has the offset parabolic reflector 42 disposed on a pole mount with its feed mounted on a long support boom.

Thus, an antenna system for use with user subscriber terminals used to communicate with low-earth orbiting (LEO) satellite communications systems has been disclosed. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. An antenna system for use in communicating with an orbiting satellite, comprising:

an offset Gregorian dual-reflector antenna that comprises:

an ellipsoidal subreflector;

a rotatable paraboloidal reflector having a focus in common with a focus of the ellipsoidal subreflector and which couples energy to and from the ellipsoidal subreflector;

an RF feed system for coupling RF energy to and from the ellipsoidal subreflector; and pointing apparatus for pointing the antenna at an orbiting satellite that comprises:

rotating apparatus for rotating the paraboloidal reflector and ellipsoidal subreflector together around an azimuth axis of the antenna and for independently and simultaneously rotating the paraboloidal reflector about an axis between the paraboloidal reflector and ellipsoidal subreflector so as to point the antenna at an orbiting satellite; and a controller coupled to the rotating apparatus for controlling rotation of the paraboloidal reflector and the antenna to point the antenna toward the orbiting satellite.

2. The antenna system recited in claim 1 in which the ellipsoidal subreflector and paraboloidal reflector of each of the antennas are offset and arranged so that the rotating apparatus causes the paraboloidal reflector to rotate about a central ray axis of the antenna thereby scanning a beam in a cone about the central ray axis with corresponding motion in elevation and azimuth.

3. The antenna system-recited in claim 2 wherein the rotating apparatus comprises stationary actuators for rotating the ellipsoidal subreflector and paraboloidal reflector.

4. The antenna system recited in claim 1 wherein the rotating apparatus rotates the ellipsoidal subreflector and paraboloidal reflector together about a vertical axis of the antenna thereby scanning a beam in an upper hemispherical cap.

5. The antenna system recited in claim 1 wherein the rotating apparatus comprises stationary actuators for rotating the ellipsoidal subreflector and paraboloidal reflector.

6. The antenna system recited in claim 1 wherein the rotating apparatus comprises first and second actuators that are simultaneously driven in such a way that the antenna beam is pointed at a desired angle in the upper hemisphere.

7. The antenna system recited in claim 6 wherein the controller provides commands to the actuators that automatically track movement of the orbiting satellite.

8. The antenna system recited in claim 1 wherein antennas are configured specifically for operation in 20 and 30 GHz frequency bands allocated for use by the orbiting satellite.

9. The antenna system recited in claim 1 wherein the RF feed system comprises a dual-frequency dual circular polarization feed system.

10. The antenna system recited in claim 9 wherein the RF feed system further comprises a solid-state polarization switch for selecting a desired polarization sense.

11. The antenna system recited in claim 1 further comprising a microwave VSAT radio including a transmitter and two receivers.

12. The antenna system recited in claim 1 wherein the orbiting satellite comprises an inclined-orbit satellite.

13. The antenna system recited in claim 1 further comprising:

a second offset Gregorian dual-reflector antenna that comprises:

an ellipsoidal subreflector;

a rotatable paraboloidal reflector having a focus in common with a focus of the ellipsoidal subreflector and which couples energy to and from the ellipsoidal subreflector;

an RF feed system for coupling RF energy to and from the ellipsoidal subreflector; and rotating apparatus for rotating the paraboloidal reflector and ellipsoidal subreflector together around an azimuth axis of the antenna and for independently and simultaneously rotating the paraboloidal reflector about an axis between the paraboloidal reflector and ellipsoidal subreflector so as to point the antenna at a second orbiting satellite;

and wherein the rotating apparatus is coupled to the controller and which rotates the paraboloidal reflector and the antenna to point the antenna toward the second orbiting satellite.

14. The antenna system recited in claim 13 further comprising a microwave VSAT radio including a transmitter and two receivers.

15. The antenna system recited in claim 14 wherein the two offset Gregorian dual-reflector antennas are mounted side-by side and the controller is coupled to one antenna to cause the antenna to be pointed at a first satellite and is coupled to the second antenna to cause the antenna to track a rising satellite, and wherein the VSAT radio is automatically handed-off to a rising satellite by switching the transmitter from the one antenna to the second antenna.

16. The antenna system recited in claim 13 further comprising a low-loss A-sandwich radome.

17. The antenna system recited in claim 16 with the A-sandwich radome has a thick core configuration that doubly-tunes the radome wall for optimum performance in 20 GHz and the 30 GHz frequency bands.

18. An antenna system for use in communicating with orbiting satellites, comprising:

first and second offset Gregorian dual-reflector antennas that each comprise:

an ellipsoidal subreflector;

a rotatable paraboloidal reflector having a focus in common with a focus of the ellipsoidal subreflector and which couples energy to and from the ellipsoidal subreflector;

an RF feed system for coupling RF energy to and from the ellipsoidal subreflector;

rotating apparatus for rotating the paraboloidal reflector and ellipsoidal subreflector together around an azimuth axis of the antenna and for independently and simultaneously rotating the paraboloidal reflector about an axis between the paraboloidal reflector and ellipsoidal subreflector so as to point the antenna at an orbiting satellite; and a controller coupled to the rotating apparatus of each antenna for controlling rotation thereof to point the first antenna toward a first orbiting satellite and point the second antenna toward a second orbiting satellite.

* * * * *